US006366061B1

(12) United States Patent
Carley et al.

(10) Patent No.: US 6,366,061 B1
(45) **Date of Patent: *Apr. 2, 2002**

(54) MULTIPLE POWER SUPPLY CIRCUIT ARCHITECTURE

(75) Inventors: L. Richard Carley, Sewickley, PA (US); Ram K. Krishnamurthy, Beaverton, OR (US); Akshay Aggarwal; Herman H Schmit, both of Pittsburgh, PA (US)

(73) Assignee: Carnegie Mellon University, Pittsburgh, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/229,953

(22) Filed: Jan. 13, 1999

(51) Int. Cl.[7] ..... G05F 1/636
(52) U.S. Cl. ..... 323/223
(58) Field of Search ..... 323/220, 223; 307/52, 60, 69, 70, 80, 85, 86

(56) References Cited

U.S. PATENT DOCUMENTS

| | | | | |
|---|---|---|---|---|
| 4,920,284 A | | 4/1990 | Denda | 307/475 |
| 4,977,335 A | | 12/1990 | Ogawa | 307/272.2 |
| 5,196,743 A | | 3/1993 | Brooks | 307/443 |
| 5,206,544 A | | 4/1993 | Chen et al. | 307/443 |
| 5,218,247 A | | 6/1993 | Ito et al. | 307/475 |
| 5,266,848 A | | 11/1993 | Nakagome et al. | 307/475 |
| 5,315,173 A | | 5/1994 | Lee et al. | 307/443 |
| 5,399,920 A | | 3/1995 | Van Tran | 326/83 |
| 5,442,218 A | | 8/1995 | Seidel et al. | 257/369 |
| 5,448,526 A | | 9/1995 | Horiguchi et al. | 365/226 |
| 5,604,453 A | | 2/1997 | Pedersen | 327/112 |
| 5,659,258 A | | 8/1997 | Tanabe et al. | 326/68 |
| 5,736,869 A | | 4/1998 | Wei | 326/81 |
| 5,814,845 A | | 9/1998 | Carley | 257/207 |
| 5,844,441 A | * | 12/1998 | Phoenix | 327/333 |
| 6,034,400 A | * | 3/2000 | Waggoner et al. | 257/355 |

FOREIGN PATENT DOCUMENTS

| | | |
|---|---|---|
| EP | 0116820 | 8/1984 |
| EP | 0381237 | 8/1990 |
| GB | 2073519 | 10/1981 |
| JP | 362029315 | 2/1987 |
| WO | WO 86/02201 | 4/1986 |

OTHER PUBLICATIONS

R.K. Krishnamurthy et al., "Mixed Swing QuadRail: Exploring Multiple Voltage Swings for Low Energy/Operation Digital Circuits," *SRC Research Report C96538*, Nov. 1996.

R.K. Krishnamurthy et al., "Static Power Driven Voltage Scaling and Delay Driven Buffer Sizing in Mixed Swing QuadRail for Sub–1V I/O Swings," IEEE/ACM Intl. Symposium on Low Power Electronics & Design, Aug. 1996, pp. 381–386.

R.K. Krishnamurthy et al., "Exploring the Design Space of Mixed Swing QuadRail for Low Power Digital Circuits," *IEEE Trans. On VLSI Systems: Special Issue on Low Power Electroncis & Design*, vol. 5, No. 4, Dec. 1997.

L.R. Carley et al., "QuadRail: A Design Methodology for Low Power ICs," *Proc. NAPA Valley Workshop on Low Power Design*, Apr. 1994.

Y. Nakagome et al., "Sub–1–V Swing Internal Bus Architecture for Future Low–Power ULSI's," *IEEE Journal of Solid State Circuits*, vol. 28, No. 4, Apr. 1993, pp. 414–419.

A. Chandrakasan et al., "Low–Power CMOS Digital Design," *IEEE Journal of Solid State Circuits*, vol. 27, No. 4, Apr. 1992, pp. 473–484.

* cited by examiner

*Primary Examiner*—Matthew Nguyen
(74) *Attorney, Agent, or Firm*—Kirkpatrick & Lockhart LLP

(57) ABSTRACT

A multiple power supply circuit architecture, such as a circuit power system including a first voltage rail, a first reference rail, a second voltage rail, a second reference rail, and a first selective connector between the first and second voltage rails.

23 Claims, 17 Drawing Sheets

MULTIPLE POWER SUPPLY CIRCUIT ARCHITECTURE

CROSS REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention is directed generally to a multiple power supply circuit architecture and, more particularly, to a method and apparatus for significantly reducing power consumption during sleep-mode without reducing circuit speed.

2. Description of the Background

Many modern integrated circuit systems shut down certain circuit blocks when their capabilities are not needed, in order to save power; e.g., sleep mode in a lap top computer. For simple static CMOS logic, sleep mode can be implemented by gating the clock that drives the latches at the input to the logic functions. For static CMOS logic, if the inputs do not change value, then only static leakage power is dissipated. Normally, static logic circuits dissipate 3 to 6 orders of magnitude less power during sleep mode, so power dissipation during sleep mode is minimal.

However, it is known to design a circuit with a two power supply system. See, for example, U.S. Pat. No. 5,814,845, issued to Carley. Such a system can reduce power consumption and maintain circuit speed. In such a circuit, however, the static leakage power is a significant fraction of the total power. That is because multiple power supply circuits sometimes cause "underdriving" of the input of static CMOS logic gates, which results in a higher leakage current, just as lowering the $V_T$ does. In general, for systems which employ CMOS logic gates without any form of preamplifiers, the voltage of the smaller power supply is adjusted such that during normal operation the power dissipated by switching (both capacitive charging power and short-circuit power) is approximately equal to the power dissipated by static leakage currents.

Some circuits have tried to address increased sleep-mode power dissipation with multiple $V_T$ MOS devices, but they require additional masks, additional space, and result in large time delays when transitioning between "sleep" mode and normal operating mode.

Therefore, the need exists for a multiple power supply architecture that reduces leakage current and delays, particularly when transitioning between normal operating mode and "sleep" mode.

BRIEF SUMMARY OF THE INVENTION

The present invention is directed to a multiple power supply circuit architecture. For example, the present invention may be embodied as a circuit power system including a first voltage rail, a first reference rail, a second voltage rail, a second reference rail, and a first selective connector between the first and second voltage rails.

The present invention may also be embodied as a circuit, including a first circuit, a first voltage rail connected to the first circuit, a first reference rail connected to the first circuit, a second circuit, a second voltage rail connected to the second circuit, a second reference rail connected to the second circuit, and a first selective connector between the first and second voltage rails.

The present invention also includes a method of controlling a power system for a circuit, including providing a first power supply, providing a second power supply, connecting the first power supply to the second power supply for sleep mode, and disconnecting the first power supply from the second power supply for non-sleep mode.

The present invention solves problems experienced with the prior art because by providing a circuit with reduced sleep-mode power consumption without reduced circuit speed. Those and other advantages and benefits of the present invention will become apparent from the description of the preferred embodiments hereinbelow.

BRIEF DESCRIPTION OF THE SEVERAL VIEWS OF THE DRAWING

For the present invention to be clearly understood and readily practiced, the present invention will be described in conjunction with the following figures, wherein.

DETAILED DESCRIPTION OF THE INVENTION

It is to be understood that the figures and descriptions of the present invention have been simplified to illustrate elements that are relevant for a clear understanding of the present invention, while eliminating, for purposes of clarity, other elements. Those of ordinary skill in the art will recognize that other elements may be desirable. However, because such elements are well known in the art, and because they do not facilitate a better understanding of the present invention, a discussion of such elements is not provided herein. In the described embodiments, logic signals with an "L" subscript swing between $V_{DDL}$ and $V_{SSL}$, and logic signals with an "H" subscript swings between $V_{DDH}$ and $V_{SSH}$. The "L" and "H" subscripts distinguish between the "low-swing" and "high-swing" of the circuit, respectively.

The present invention will be described in terms of a doped silicon semiconductor substrate, although advantages of the present invention may be realized using other structures and technologies, such as silicon-on-insulator, silicon-on-sapphire, and thin film transistor.

Figure 1:
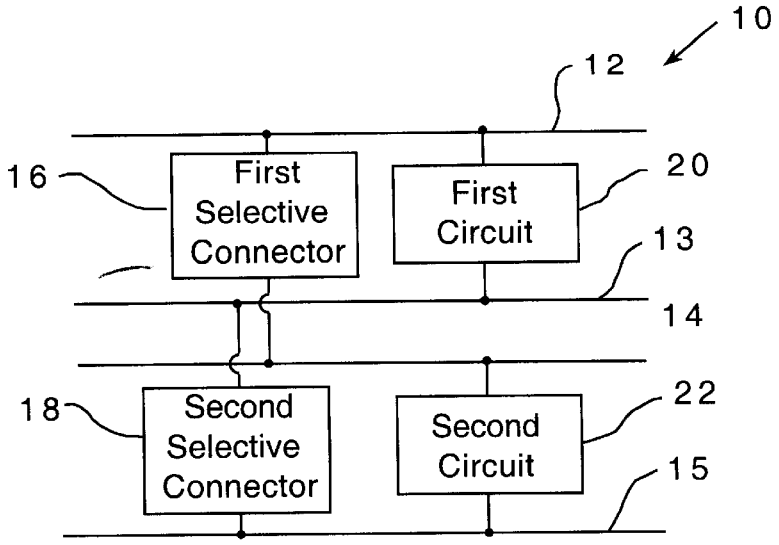
FIG. 1 is a block diagram illustrating a circuit in accordance with the present invention.

FIG. 1 is a circuit schematic illustrating a circuit 10 in accordance with the present invention. The circuit 10 employs multiple voltages at the gate level while still allowing for the retention of a static CMOS-based logic gate structure. That structure mixes high-swing and low-swing signals by, for example, operating non-critical path gates with the low-swing voltages and operating critical path gates with high swing voltages. Significant power reductions are realized because there are no DC paths between the power supplies.

The circuit 10 includes a first voltage rail 12, a first reference rail 13, a second voltage rail 14, and a second reference rail 15. A first selective connector 16 is connected between the first and second voltage rails 12, 14, and a second selective connector 18 is connected between the first and second reference rails 13, 15. A first circuit 20 is connected to the first voltage and reference rails 12, 13, and a second circuit is connected to the second voltage and reference rails 14, 15. The first and second circuits 20, 22 may be any types of circuits such as, for example, logic circuits.

The voltage and reference rails 12–15, under normal operation, are two separate power supplies. The first power supply is formed by the first voltage and reference rails 12, 13, and the second power supply is formed by the second voltage and reference rails 14, 15. However, the power supplies formed by the voltage and power rails 12–15 are not identical. One power supply typically has a larger voltage swing than the other. In addition, the voltage swings may be overlaping or non-overlapping, and centered or non-centered. However, certain benefits are realized if the power supplies are centered (that is, the midpoint of one power supply is the same as the mid point of the other, even though the power supplies have different voltage swings). For example, if the supplies are centered, high and low noise margins are maximized and rising and falling delays are equalized. Although the present invention is illustrated as having four rails 12–15, forming two power supplies, and two selective connectors 16, 18, the present invention is not limited to that embodiment. For example, a six rail, three power supply system using three selective connectors can also realize the benefits of the present invention. More rails, connectors, and circuits may also be used.

The first and second selective connectors 16, 18 are sleep-mode enable devices that keep the power supplies separate during normal operation. However, during the sleep mode, or low power mode, the first and second voltage rails 12, 14 are shorted together, and the first and second reference rails 13, 15 are shorted together, thereby eliminating the DC path power consumption that exists during normal operating mode. When the rails 12–15 are shorted together, both power supplies are operating at the same or nearly the same voltage. The present invention will be described in terms of the shorted power supplies operating at the high swing voltage, although benefits of the present invention may also be realized if the shorted power supplies are instead operated at the low swing voltage.

The selective connectors 16, 18 may be, for example, mechanical switches or solid state switches, such as transistors. The selective connectors 16, 18 may also be more complex devices, such as power supplies, to selectively create a potential between the rails when no connection is desired, and to selectively create a zero potential between the rails when a connection or short is desired. Examples of such power supplies are series-regulated power supplies and switching power supplies.

An advantage of shorting the power supplies together to enter sleep mode is that it results in extremely little static leakage power dissipation. Unlike prior art circuits, however, the present invention provides a circuit 10 that is fully functional at all times, even in sleep mode. More particularly, when the first and second power supplies are shorted together, the entire circuit is still functional at full clock speed. Furthermore, the circuit 10 does not suffer from any recovery delay when it operates in sleep mode. For example, if the circuit 10 is in sleep mode, the second circuit 22 (as well as the first circuit 20) is still completely functional because it is powered by the high swing voltage. In fact, the second circuit may operate more quickly in sleep mode than in normal mode because it is being driven by a higher voltage. However, operating the second circuit 22 in sleep mode may result in more power being consumed because of the higher voltage driving the second circuit.

Alternatively, only one selective connector, such as 16, may be provided, so that only one pair of rails, such as 12, 14, are connected together during sleep mode. In that embodiment, the other selective connector 18 is eliminated and the rails 13, 15 are not connected together during sleep mode. For example, the rails 13, 15 not connected together during sleep mode may be at the same potential so that there is no need to connect them together. In that embodiment, one of those rails, such as 14, may be eliminated and all of the circuits may be tied to the remaining rail 15.

Figure 2:
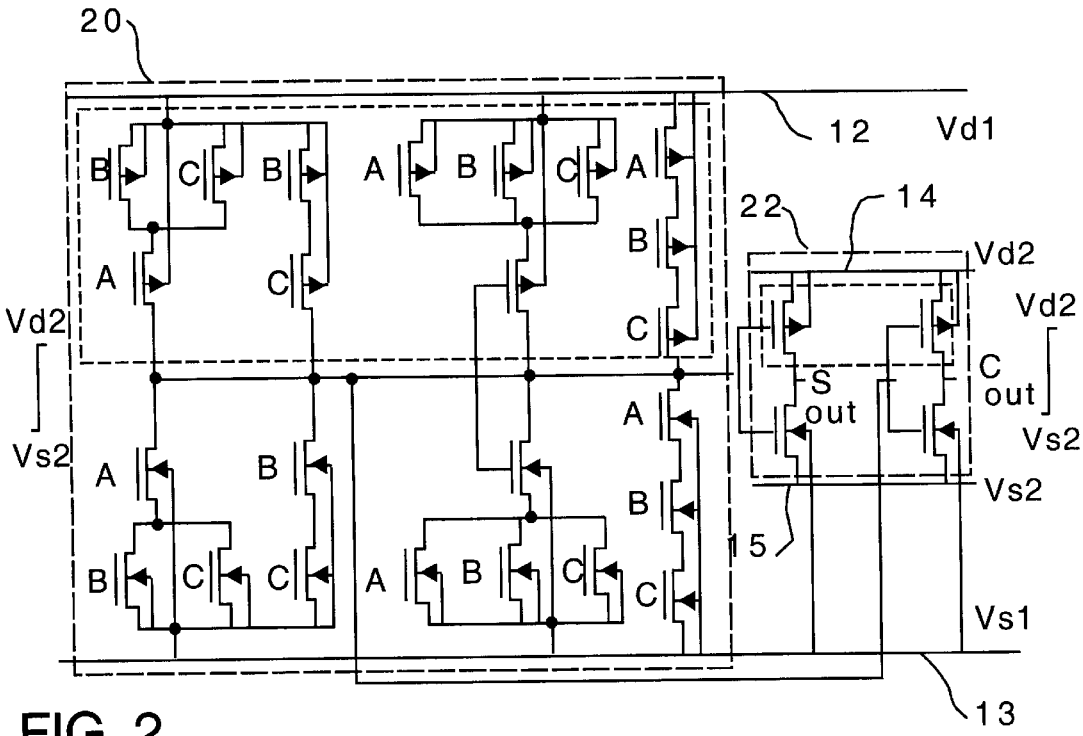
FIG. 2 is a circuit schematic illustrating a counter constructed according to the present invention.

FIG. 2 is a circuit schematic illustrating a counter constructed according to the present invention. In that embodiment, the first circuit 20 is a logic stage and the second circuit 22 is a driver/buffer stage. The high swing power supply and low swing power supply are approximately centered. The PMOS devices may have independent N-wells for minimal body-effect on the buffer stage PMOS devices. In addition, the NMOS devices may reside in the native P-substrate to facilitate a single threshold, N-well based process.

Figure 3:
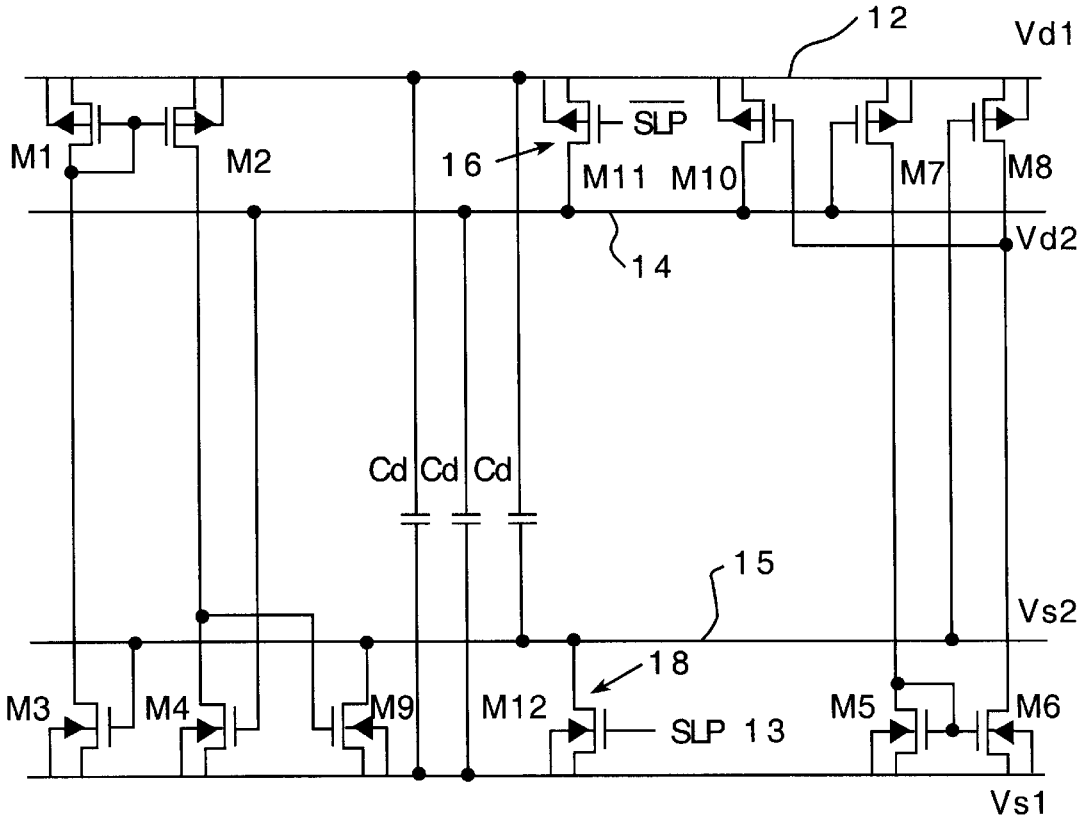
FIG. 3 is a circuit schematic illustrating a series regulator circuit according to one embodiment of the present invention.

FIG. 3 is a circuit schematic illustrating a series-regulator circuit for regulating the high swing and low swing power supplies for the counter illustrated in FIG. 2. The high swing power (first voltage and reference rails 12, 13) may be supplied either off-chip or on-chip. The low swing power (second voltage and reference rails 14, 15) may be servoed to maintain a fixed ratio of off-drive to average on-drive current ($I_{off}/I_{on}$) in order to balance static and dynamic power. As a result, total power may be minimized without any process modifications.

In one embodiment, the transistor pairs M3:M4 and M7:M8 are ratioed Nx:1x, where 1x is the minimum-width transistor and N is the target $I_{on}/I_{off}$ ratio. The PMOS devices may be ratioed wider than the NMOS devices in order to equalize their respective drive capabilities. The current mirror devices M1:M2 and M5:M6 may be ratioed 1:1. M9 and M10 provide the DC series path between the power rails and are sized to be able to source and sink the peak on-drive current requirement. Three local inter-rail decoupling capacitors ($C_d$) each with a value of, for example, 4pF may be used to reduce rippling on the low-swing rails 14, 15 caused by simultaneous switching noise on the low-swing and high-swing rails.

Transistors M11 and M12 are disabled (SLP=Vs1) during normal operation. However, during sleep mode (SLP=Vd1), or low power mode, the low swing rails are shorted to the high swing rails, eliminating DC path power consumption that exists during active mode.

Figure 4:
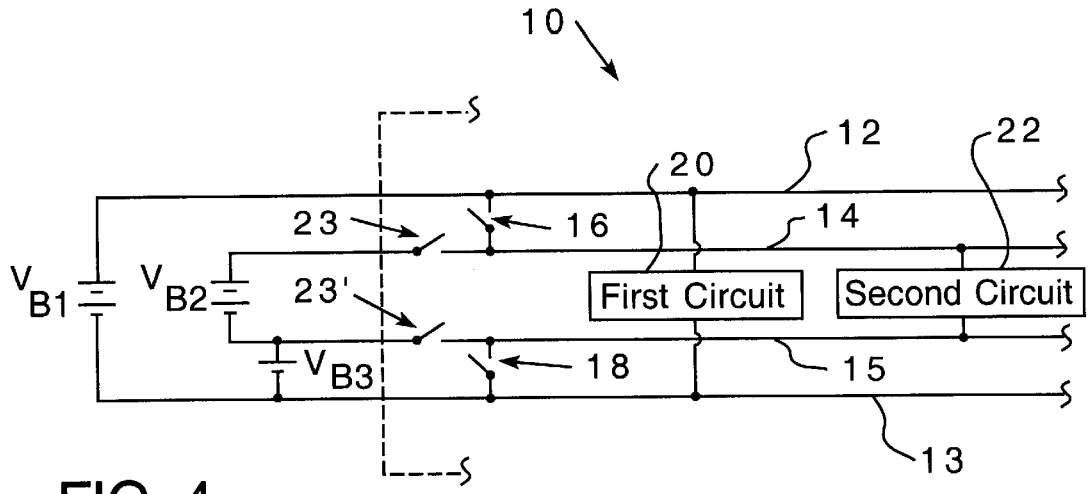
FIG. 4 is a circuit schematic illustrating an embodiment of the present invention with external power.

FIG. 4 is a circuit schematic illustrating an embodiment of the present invention with external power. Power supplies $V_{B1}$, $V_{B2}$, and $V_{B3}$ are provided external of the device 10, such as off-chip. In sleep mode, first and second selective connectors 16, 18 are closed and connectors 23, 23' are open to remove power supply $V_{B2}$ from the second voltage and reference rails 14, 15. In normal mode, selective connectors 16, 18 are open and connectors 23, 23' are closed.

Figure 5:
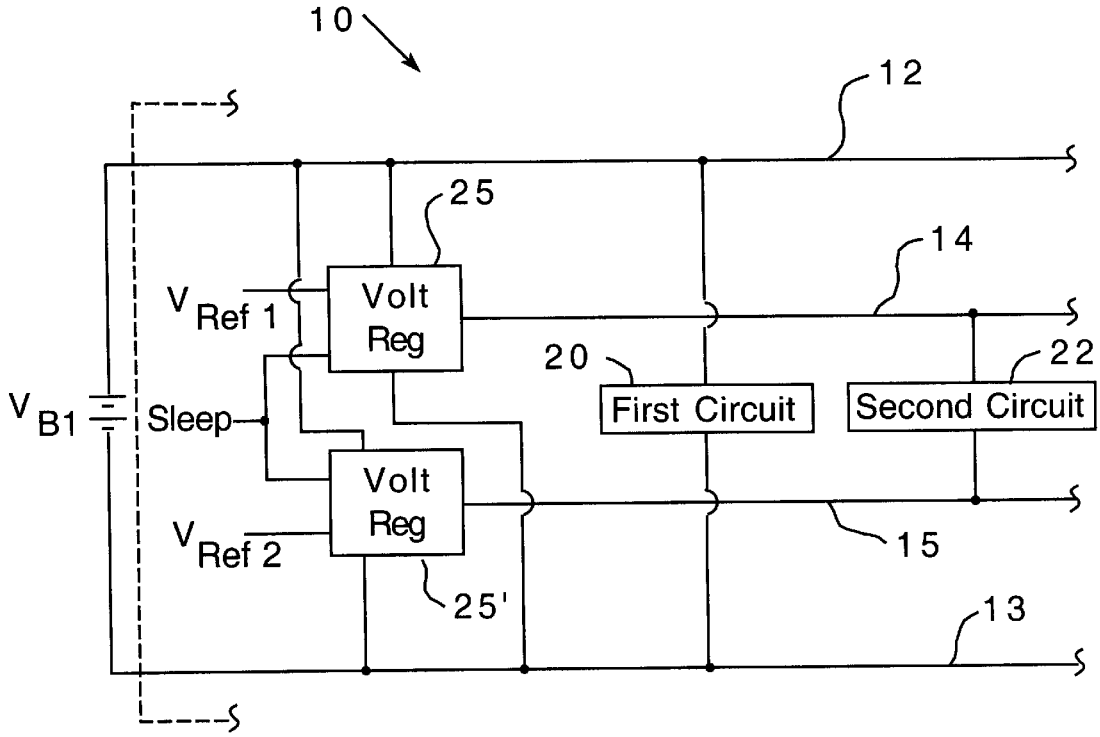
FIG. 5 is a circuit schematic illustrating another embodiment of the present invention with an external power.

FIG. 5 is a circuit schematic illustrating another embodiment of the present invention with an external power. A single power supply $V_{B1}$ provides power to voltage regulators 25, 25', which regulate the second voltage and reference rails 14, 15. In sleep mode the voltage regulators 25, 25' connect the first and second voltage rails 12, 14 together and connect the first and second reference rails 13, 15 together. In normal mode, the voltage regulators 25, 25' generate separate swing voltages on the rails 12–15. $V_{B1}$ may be located external of the device 10, such as off-chip, while the voltage regulators 25, 25' and all other illustrated components may be located on the device 10.

Figure 6:
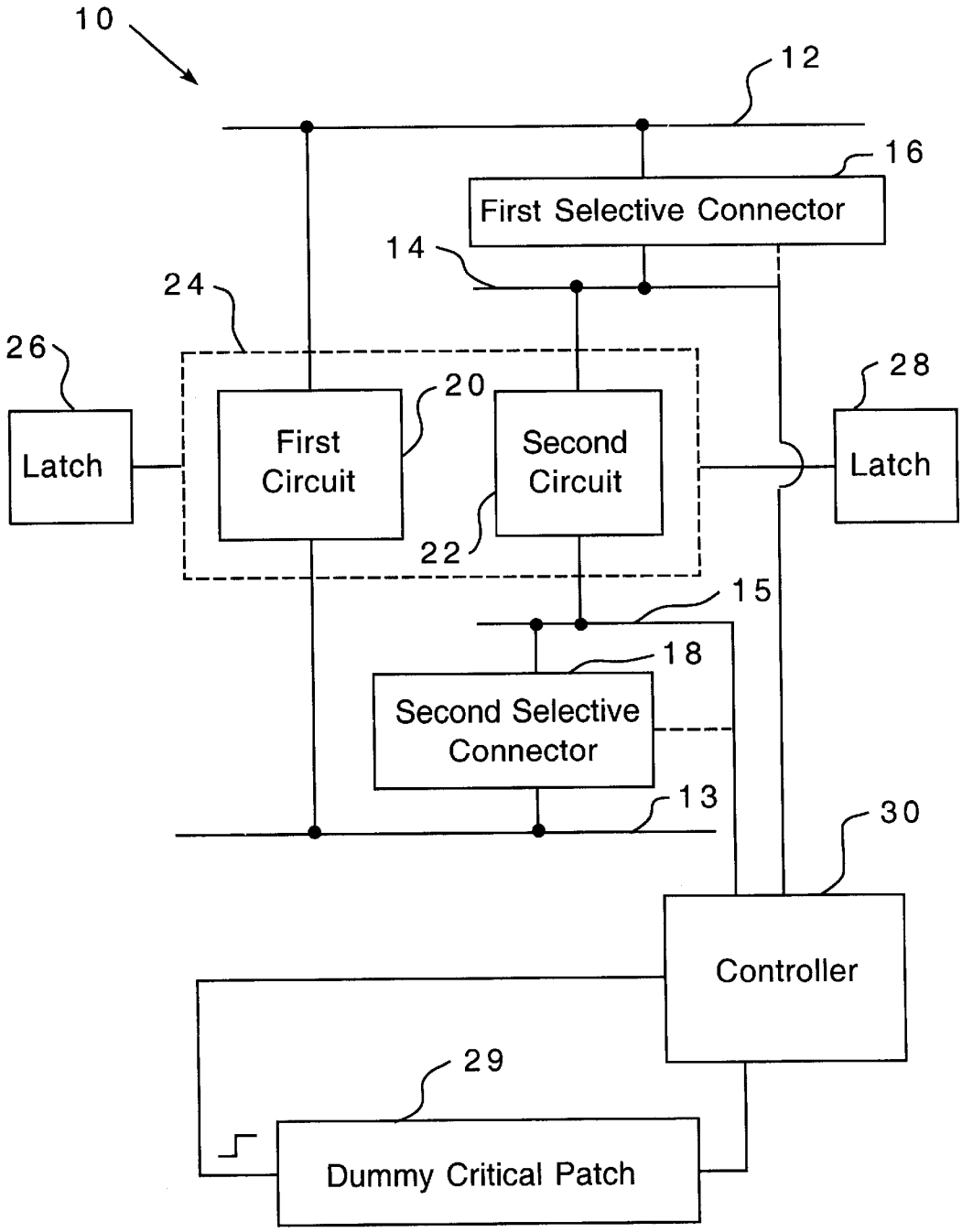
FIG. 6 is a circuit schematic illustrating a circuit including a controller and a dummy critical path.

FIG. 6 is a circuit schematic illustrating another embodiment of the present invention with a dummy critical path 29 and a controller 30. The circuit 10 may be used in situations where it is important to optimize latch-to-latch delay and timing. The circuit 10 includes a circuit block 24 including the first and second circuits 20, 22 and connecting first and second latches 26, 28. It also includes a dummy critical path 29 and a controller 30. As described hereinbelow, the dummy critical path 29 may be eliminated in some embodiments.

The dummy critical path 29 simulates the critical path of the logic block 24, so as to provide feedback to the controller 30 indicative of the speed at which signals are propagating through the critical path of the logic block 24. As a result, the dummy critical path 29 provides feedback to the controller 30 regarding factors that affect the speed of the circuit 10, such as changes in temperature, changes in operating voltage, and manufacturing variations. The dummy critical path 29 does not necessarily have to simulate the entire logic block 24 to be effective. For example, the dummy critical path 29 may simulate the only a portion of the logic block 24, such as the second circuit 22 which, in the illustrated embodiment, is operating at the lower voltage.

The controller 30 controls the voltage of the second voltage and reference rails 14, 15. The controller 30 may control the voltage on the rails 14, 15 directly, or it may control them indirectly, such as by controlling the first and second selective connectors 16, 18 (as illustrated with broken lines in FIG. 6). The controller 30 may also receive feedback from the second voltage and reference rails 14, 15. The controller 30 may also receive feedback from the dummy critical path 29. The controller 30 uses the feedback from the dummy critical path 29 to adjust the low swing voltage of the second voltage and reference rails 14, 15. For example, the low swing voltage may be reduced until the signals do not propagate quickly enough through the dummy critical path, thereby minimizing power consumption and still maintaining adequate signal speed. Alternatively, the low swing voltage may be adjusted until dynamic power and static power are equal, such as may be determined from the ratio of $I_{off}/I_{on}$. The controller 30 may periodically check the dummy critical path 29 to compensate for changing conditions, such as temperature variations.

In another embodiment, the first and second selective connectors 16, 18 may be eliminated and the circuit 10 may operate in a more conventional mixed swing quadrail configuration.

In another embodiment, the dummy critical path 29 may be eliminated. For example, the controller 30 may measure signal propagation through the actual critical path when the circuit 10 is not otherwise being used. In that embodiment, the controller 30 may be connected to the front and back of the critical path, such as near the first and second latches 26, 28, so as to produce and measure the propagation of a signal through the critical path.

Figure 7:
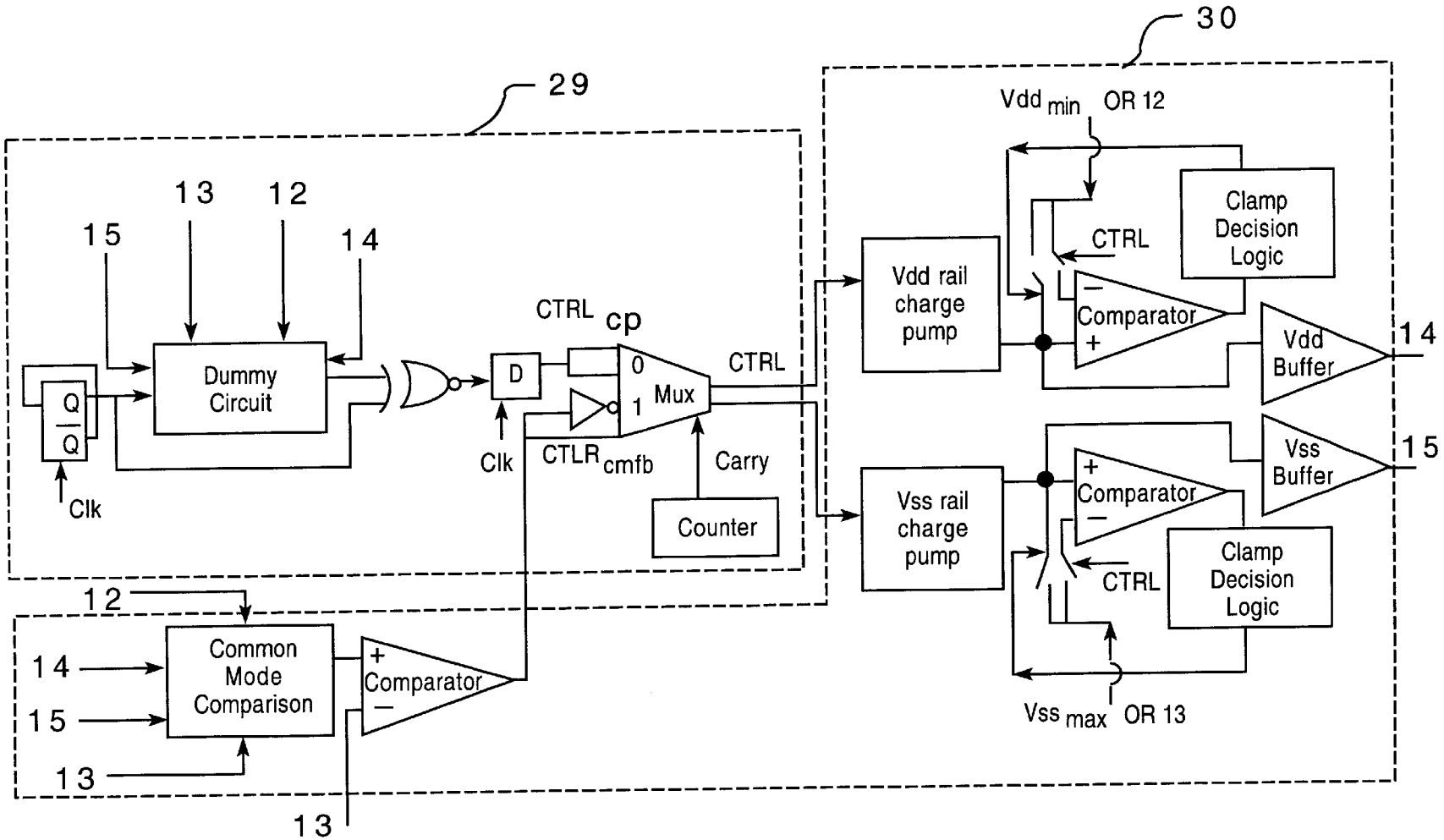
FIG. 7 is a circuit schematic illustrating a circuit for dynamically adjusting the second voltage and reference rails based on delay tracking.

FIG. 7 is a circuit schematic illustrating a circuit for dynamically adjusting the second voltage and reference rails 14, 15 based on delay tracking. The dummy critical path 29 includes a dummy circuit and associated control circuitry. The dummy circuit may be located in close physical proximity to the second circuit 22 so that the dummy circuit is very similar to the second circuit 22 in variations, such as process and temperature variations, and therefore is representative of the worst case performance of the second circuit 22. Nonetheless, additional "slack", such as about ten percent, may be added to the dummy circuit as a safety margin. The charge pumps in the controller 30 decrease or increase the low voltage swing on rails 14, 15, depending on whether or not, respectively, the dummy circuit meets the target clock CLK performance. As a result, the voltage on rails 14, 15 may be fine tuned to the point where the dummy circuit has a delay that matches the target delay. A voltage minimum level (Vddmin/Vssmax) determines the minimum allowable low swing defined by rails 14, 15, which may be desired for balancing static and dynamic power or for other reasons, such as maintaining minimum allowed noise margins. The common mode comparison block helps to keep the rails 14, 15 centered. The buffer drivers in the controller 30 supply the voltages carried on rails 14, 15 to other parts of the circuit 22.

Figure 8:
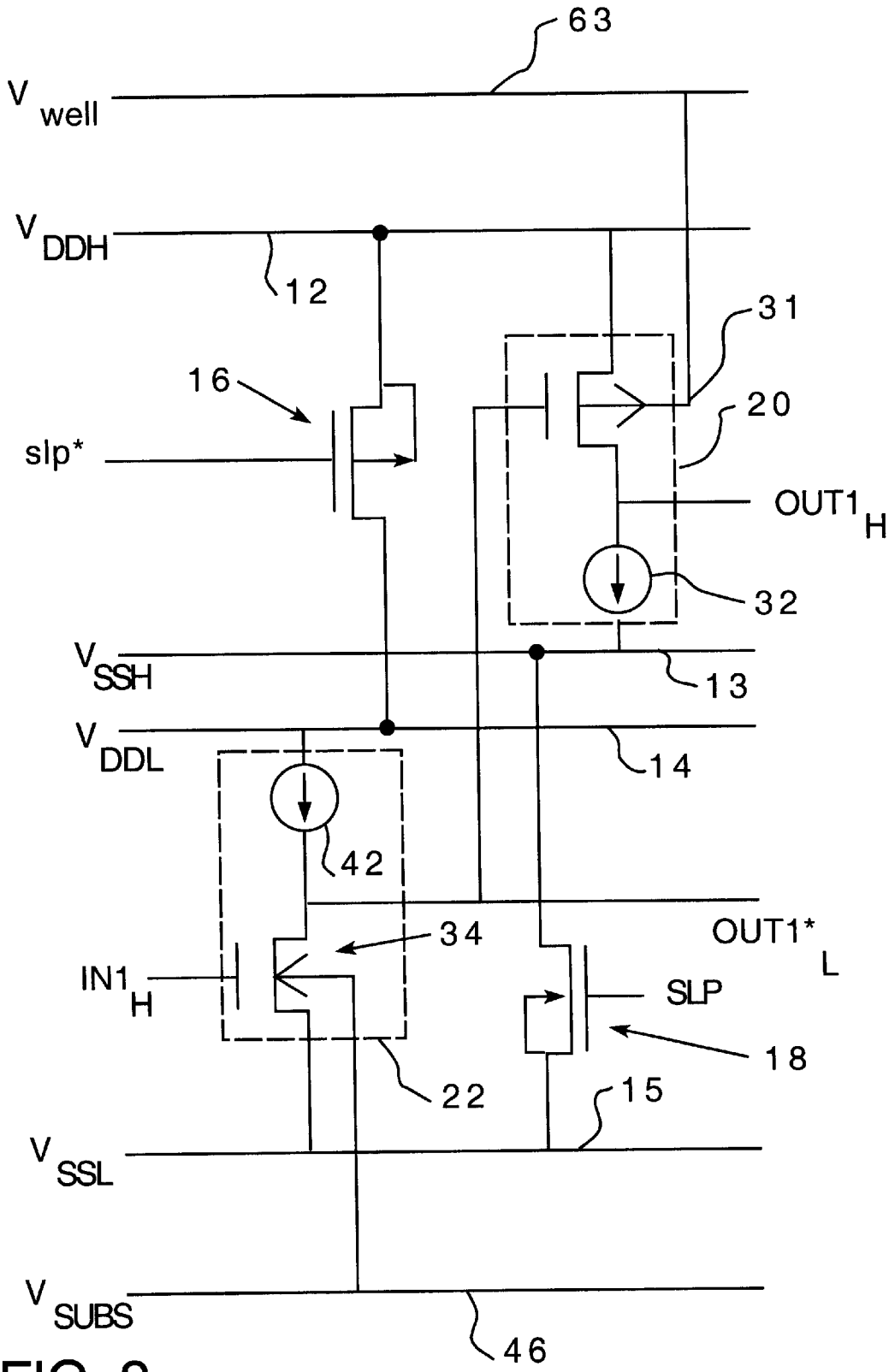
FIG. 8 is a circuit schematic illustrating another embodiment of the present invention.

FIG. 8 is a circuit schematic illustrating another embodiment of the present invention. The first and second selective connectors 16, 18 are embodied as NMOS and PMOS transistors, respectively. The NMOS and PMOS transistors are controlled by sleep signals SLP* and SLP, respectively, at their gates. The signals SLP* and SLP may be provided to the selective connectors 16, 18 by, for example, a logic circuit (not shown), such as may be used to produce other control signals for the circuit 10. The first circuit 20 includes a PMOS transistor 31 and a current source 32. The second circuit 22 includes an NMOS transistor 34 and a current source 42.

Figure 9:
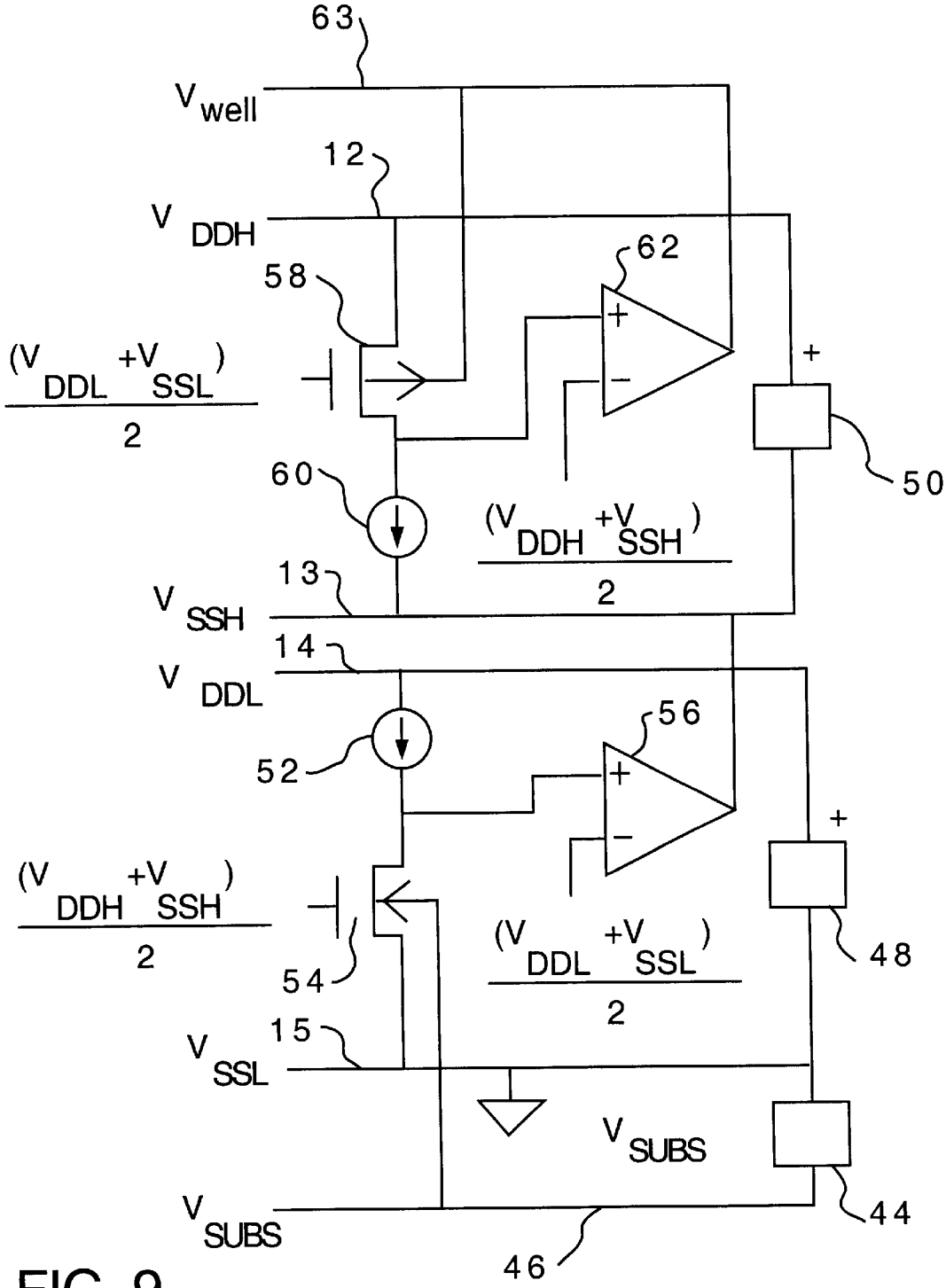
FIG. 9 is a circuit schematic illustrating a circuit for monitoring supply voltage and generating bias voltages.

FIG. 9 is a circuit schematic illustrating a circuit for monitoring the supply voltages at the rails 12–15, and for generating the bias voltages. Such a circuit is sometimes desirable because there are often significant variations in threshold voltages. Additionally, threshold voltages may change over time or as a result of changes in temperature. Accordingly, it is sometimes desirable to monitor at least some of the voltages carried by the rails 12–15, as well as to back bias the substrate and wells carrying the transistors 20, 22. In circumstances where a circuit such as that illustrated in FIG. 9 is not necessary, the voltages carried by the rails 12–15 may be supplied by fixed power supplies, such as batteries.

Back biasing of the substrate is accomplished by a floating power supply 44 connected to the substrate via a conductor 46. Once substrate voltage $V_{SUBS}$ is set, it remains substantially fixed. Accordingly, it may be more appropriate to refer to power supply 44 as an adjustable power supply. One reason for back biasing the substrate is to match the threshold voltages with $V_{WELL}$ above the value of the voltage $V_{DDH}$. For example, to substantially reverse bias the PMOS junction capacitances one may place a large back bias on the substrate, e.g. $V_{SUBS}=V_{SSL}-3$ volts.

Typical values which may be used in the circuit shown in FIG. 9 include $V_{SSL}$ set to ground potential and $V_{SUBS}$ set at −3 volts. The voltage difference across second voltage and reference rails 14, 15 may be small (e.g. 0.25 volts) and is set by a floating power supply 48 connected across third and fourth rails 14, 15. $V_{DDH}-V_{SSH}$ may be equal to $V_{DDH}-V_{SSL}$ (e.g. 0.25 volts). $V_{SSH}$ and $V_{WELL}$ may then be determined because the voltage difference between rails 12, 15 must be greater than the threshold voltages of the devices, and $V_{WELL}$ must be greater than $V_{DDH}$.

$V_{SSH}-V_{SSL}$ determines the off current flowing through NMOS input transistor 34. Where $V_{SSL}$ is zero volts, $V_{SSH}$ determines the off current. A typical value for $V_{SSH}-V_{SSL}$ is approximately one volt. One of the benefits of the multiple power supply architecture of the present invention is that the value $V_{SSH}-V_{SSL}$ may be adjusted to make up for variations in the threshold voltages of the n-type devices. The value of $V_{SSH}$ may be allowed to float to compensate for $V_{TN}$. A floating power supply 50 is provided across first voltage and reference rails 12, 13 so as to apply approximately 1.25 volts to the first voltage rail 12 and one volt to the first reference rail 13. However, the first reference rail 13 is also connected to a negative feedback loop comprised of a constant current source 52 and NMOS transistor 54 connected across rails 14 and 15. The transistor 54 receives a signal at its gate terminal which is representative of the midpoint between the voltages carried by rails 12, 13, i.e., $(V_{DDH}+V_{SSH})/2$. The output of the transistor 54 is connected to a non-inverting put terminal of an operational amplifier 56. An inverting input terminal of the operational amplifier 56 receives a voltage representative of the midpoint of the voltages carried by rails 14 and 15, i.e., $(V_{DDL}+V_{SSL})/2$. An output terminal of the operational amplifier 56 is connected to rail 13. Because of the negative feedback loop comprised of current source 52, transistor 54, and operational amplifier 56, $V_{SSH}$ is allowed to float to precisely compensate for the value of $V_{TN}$.

The threshold of transistor 34 $V_{TNS}$ will likely be large when several volts of negative bias are applied to the substrate to decrease the junction capacitances of the n-type devices. However, the exact value of $V_{SSH}-V_{SSL}$ is derived from the feedback loop comprised of current source 52, transistor 54, and operational amplifier 56 which determine the necessary difference to achieve a desired mid-point (half way between "on" and "off") current level for transistor 34. The on current level is the current through transistor 34 when its gate to source voltage $V_{GS}$ is at $V_{DDH}-V_{SSL}$. It is typical, but not necessary, that $V_{DDH}-V_{SSH}=V_{DDL}-V_{SSL}$. The exact opposite is true for the PMOS input gate 31. In that case, the off current is given by the current through the PMOS transistor 31 with $V_{GS}=V_{DDL}-V_{DDH}$ and its on current is determined by $V_{GS}=V_{SSL}-V_{DDH}$. Because the same voltage difference determines the off current for the NMOS and PMOS devices, this circuit will work correctly when $V_{TN}=V_{TP}$. A feedback loop adjusts the value of $V_{WELL}$ until the threshold of the n-type devices and the p-type devices match. Another reason for back biasing the substrate is to ensure that $V_{TS}$ can be matched with $V_{WELL}$ above $V_{DDH}$.

FIG. 9 also illustrates a feedback loop for adjusting $V_{WELL}$. That feedback loop includes a transistor 58 series-connected with a current source 60 across first voltage and reference rails 12, 13. The transistor 58 receives at its gate terminal a signal representative of the midpoint in the voltage across the second voltage and reference rails 14, 15, i.e., $(V_{DDL}+V_{SSL})/2$. The output of the transistor 58 is input to a non-inverting input terminal of an operational amplifier 62. An inverting input terminal of the operational amplifier 62 receives a voltage representative of the midpoint in the voltages across rails 12, 13 i.e., $(V_{DDH}+V_{SSH})/2$. The voltage $V_{WELL}$ available at an output terminal of the operational amplifier 62 is connected to the well through a conductor 63.

The proposed architecture is able to offset the nominal value of $V_T$ of each component and nearly all of the variation in $V_T$. Alternatively, $V_T$ may be controlled by varying the nominal value of $V_T$ during the manufacturing process, and by imposing more stringent limitations on its variance during manufacturing.

Figure 10:
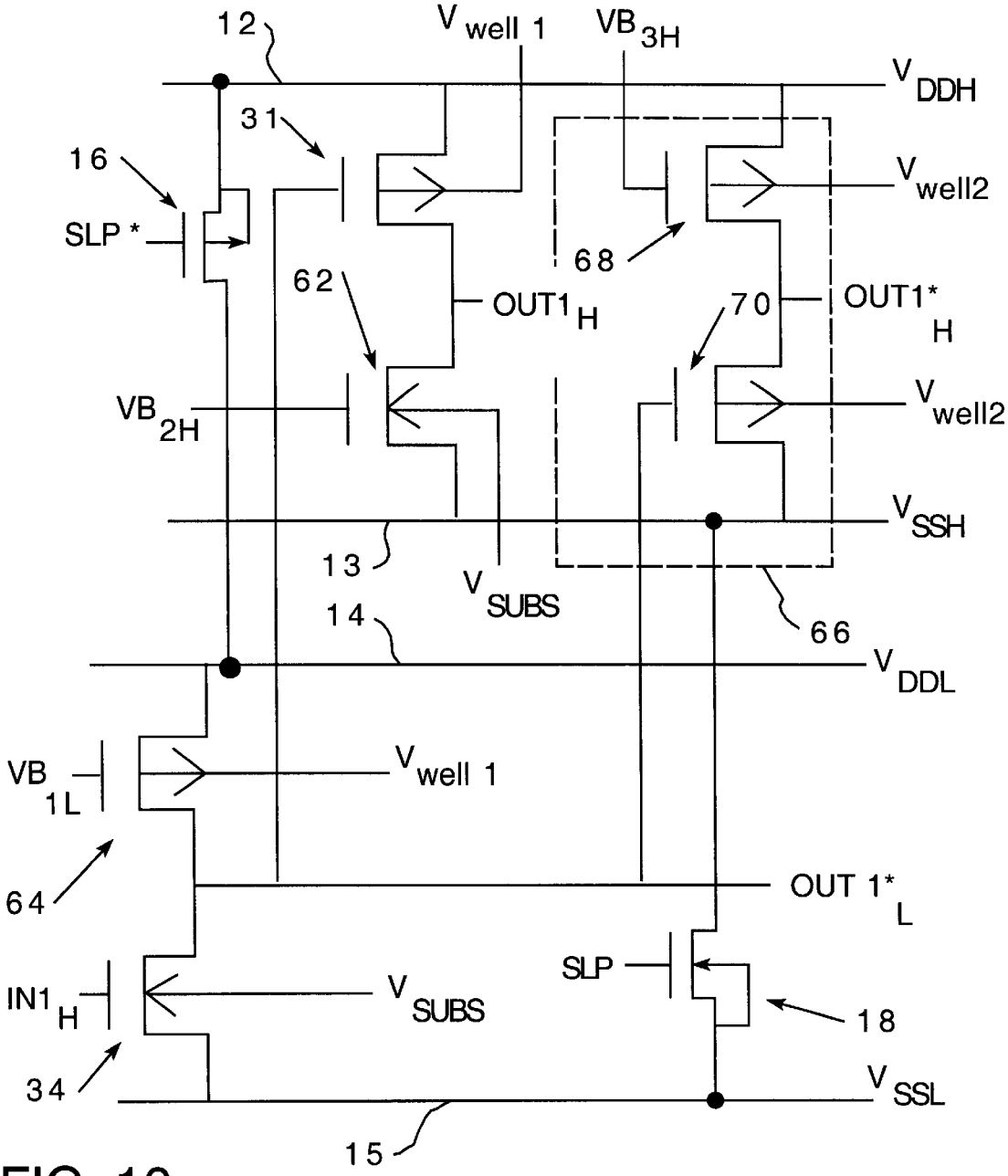
FIG. 10 is a circuit schematic illustrating another embodiment of the circuit illustrated in FIG. 8.

FIG. 10 is a circuit schematic illustrating another embodiment of the circuit illustrated in FIG. 8. The current sources 32, 42 are implemented by transistors 62, 64. Transistor 64 acts as a variable current source so the load capacitance can be charged up in the required fraction of a clock cycle. For example, the signal $VB_{IL}$ input on the gate terminal of the transistor 64 may be on the order of −0.75 volts to −2 volts. The signal $VB_{2H}$ input to the gate terminal of the transistor 62 provides a similar function of setting the value of the current source and may assume a value of 2 volts to 3.5 volts.

The follower circuit 66 is comprised of two series connected PMOS transistors 68 and 70 connected across rails 12 and 13. The transistor 68 acts as a constant current source. Its value is set by an input signal $VB_{3H}$ in a manner similar to that previously described in conjunction with the signal $VB_{1L}$. Transistor 70 receives at its gate terminal the output signal $OUT1_L$. The follower circuit 66 produces an output signal $OUT1_H$. In the illustrated embodiment, the follower has a gain substantially less than one (0.5 to 0.8), so its output swing will not be full rail-to-rail. Accordingly, the output signal may be buffered, such as with another logic gate.

The PMOS transistors 68, 70 may be fabricated in a well separate from the well of the other p-type transistors. Thus, a separate well bias voltage $V_{WELL2}$ may be provided. The signal $V_{WELL2}$ can be produced using the concepts illustrated in conjunction with FIG. 3 but using a reference circuit matched to transistors 68, 70 and connecting the inverting input terminal of the operational amplifier to the reference circuit output.

Figure 11:
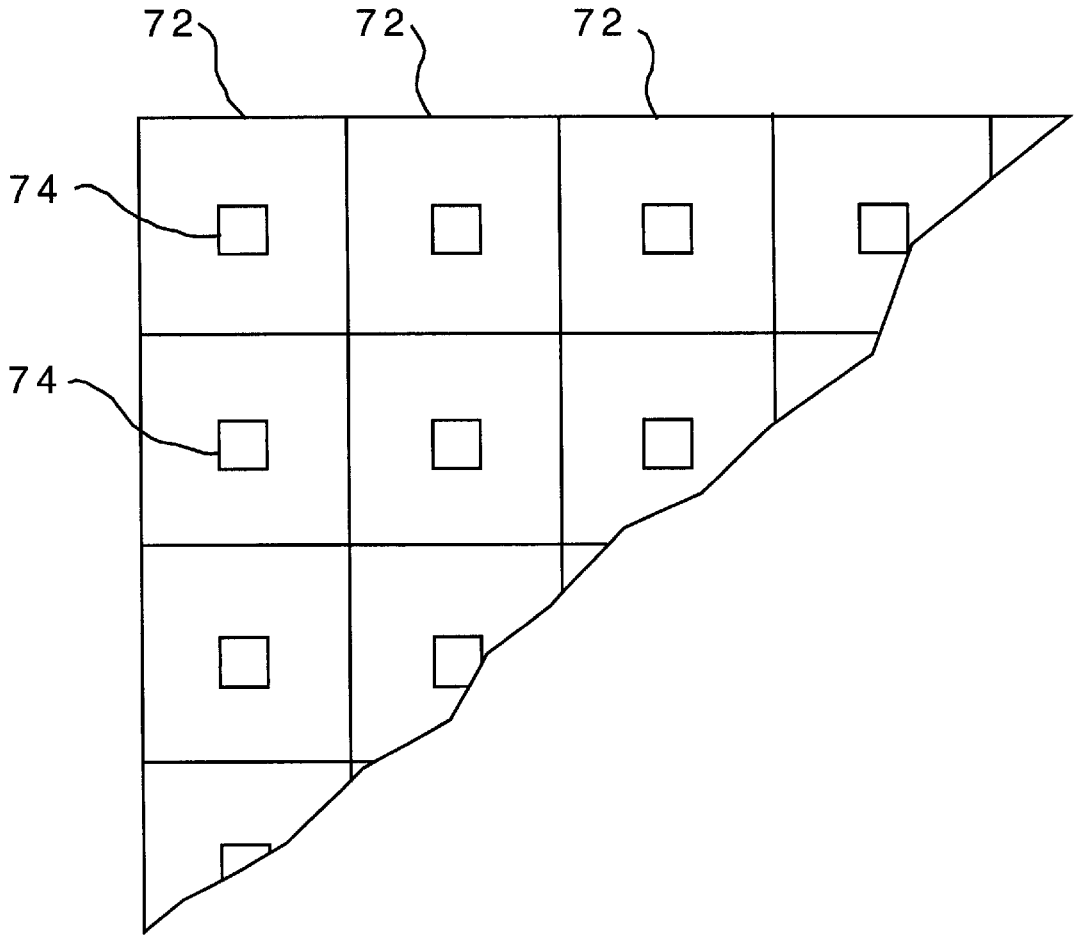
FIG. 11 is a plan view of an application of the present invention in which the local area adjustment divides a die into smaller regions.

The circuit architecture of the present invention can be applied at two different levels of threshold offset adjustment: local-area adjustment and die-level adjustment. Die-level adjustment would use the same values for $V_{SSH}$ and $V_{WELL}$ across the entire die. That embodiment will offset some of the systemic variations in $V_{TN}$ a $V_{TP}$ across the wafer and will offset all of the variations between runs. Local-area adjustment divides the die into smaller regions 72, as illustrated in FIG. 11. In each region 72, the values for $V_{SSH}$ and $V_{WELL}$ would be determined by a local circuit 74, such as that illustrated in FIG. 9. To facilitate better voltage range compatibility, only the outputs from the substrate device gates may be distributed between regions 72. For example, for an n-type well process, the output swinging from $V_{SSL}$ to $V_{DDL}$ should be distributed between regions because the value of $V_{SSH}$ varies between regions. That would also hold true for interconnections between different integrated circuits.

Figure 12:
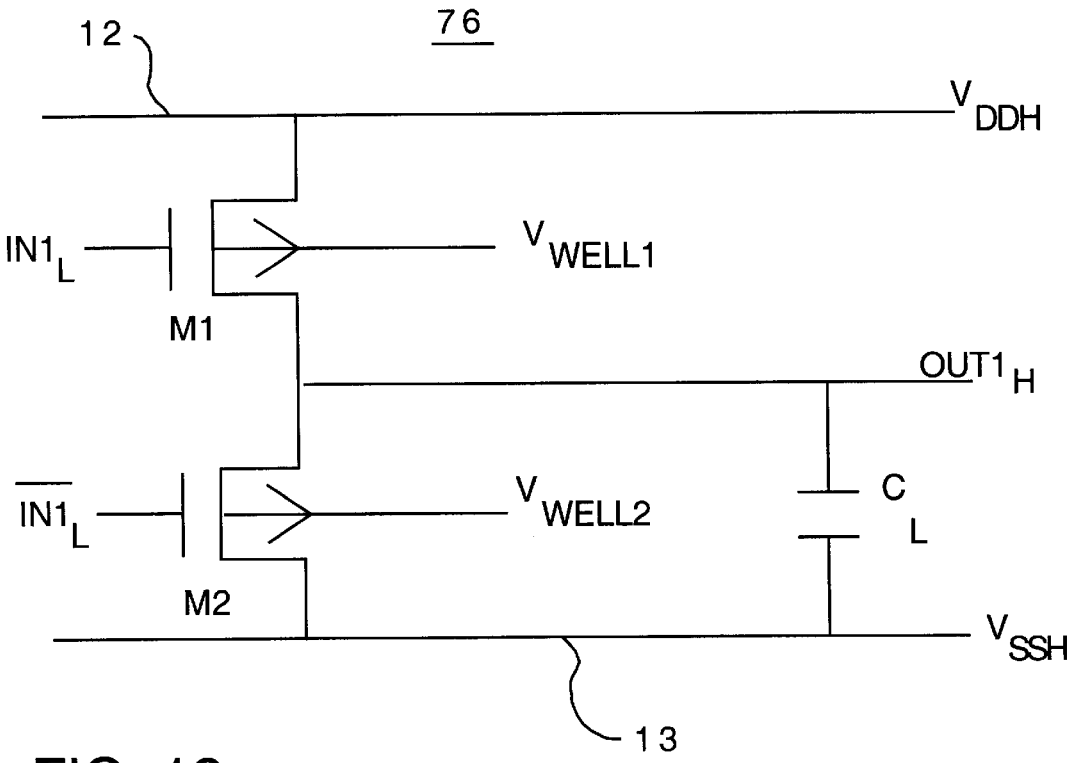
FIG. 12 is a circuit schematic illustrating a Class B driver/buffer according to the present invention.

FIG. 12 illustrates a Class B driver/buffer 76. Like static CMOS, either M1 is on and M2 is off, or vice versa. No static power is dissipated by the Class B buffer 76 except for leakage currents. However, because M1 is operating in common-source mode and M2 is operating in common-drain mode, the well voltages of M1 and M2 may be adjusted separately by area-wide or chip-wide bias generators to make the switching point of the buffer 76 occur at the midpoint of the input swing.

Figure 13:
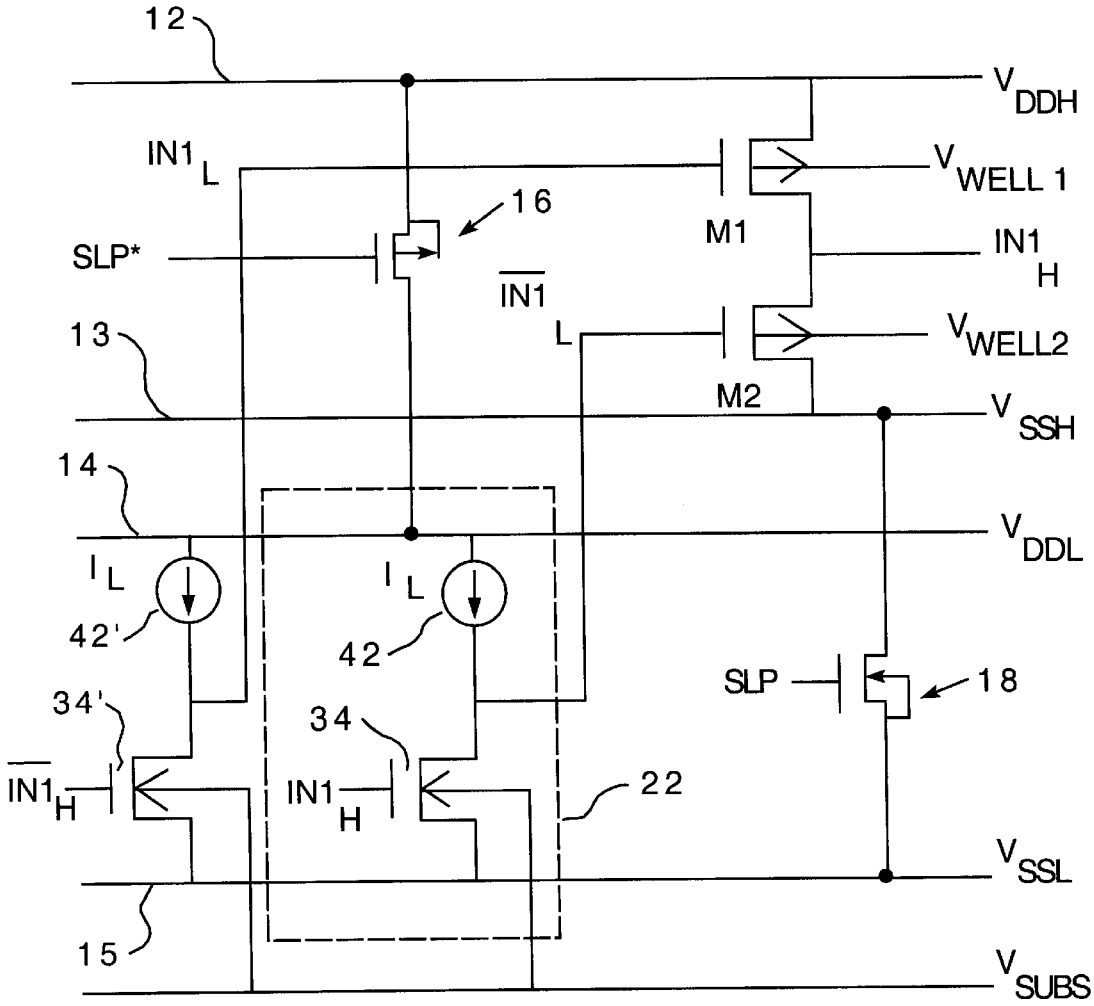
FIG. 13 is a circuit schematic illustrating a portion of FIG. 8 integrated with the circuit of FIG. 12.

FIG. 13 is a circuit schematic illustrating the second circuit 22 of FIG. 8 connected to a Class B buffer circuit 76 of the type shown in FIG. 12. A transistor 34' and a current source 42' provide a signal that is the complement of the signal to be buffered.

Figure 14:
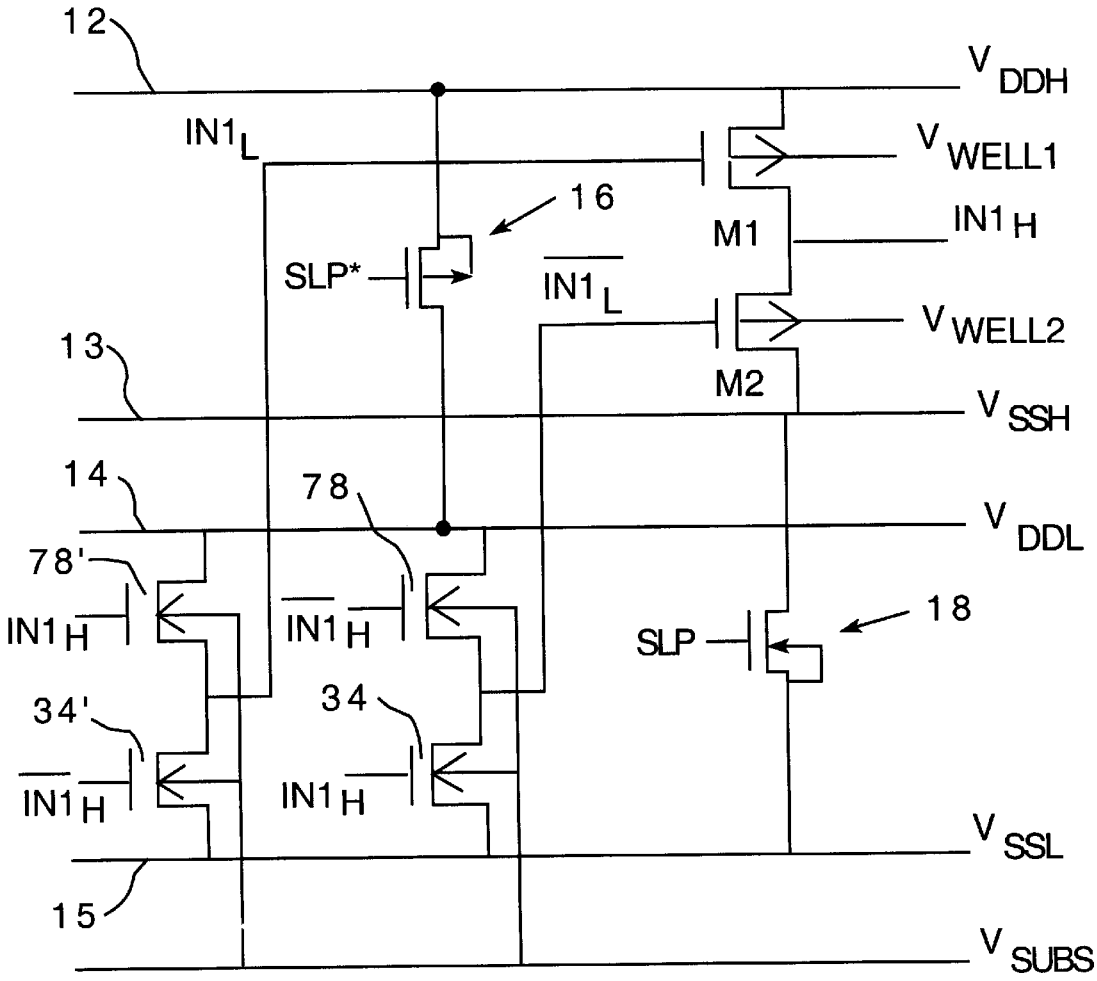
FIG. 14 is a circuit schematic illustrating another embodiment of the circuit of FIG. 13.

FIG. 14 is another embodiment of the device illustrated in FIG. 13. The current source 42' is embodied by a transistor 78' which is responsive to the complement of the signal input to transistor 34'. Because the transistors 78' and 34' are responsive to the true and compliment, respectively, of the same signal, power is dissipated only during switching. Similarly, the current source 42 is embodied as a transistor 78 so that power is dissipated by those transistors only during switching. Thus, while the circuit shown in FIG. 13 may be viewed as a Class A/B circuit, the circuit shown in FIG. 14 is a Class B/B circuit.

The transistors 34', 78', 34, 78 may be all located on the same substrate such that adjustment of the well potential as was done with transistors M1 and M2 is not possible. Under such conditions, one may ratio the widths of the transistors to compensate for differences in gain caused, for example, by different modes of operation. Thus, in FIG. 13, the width of transistor 34 is greater than the width of transistor 78 and the width of transistor 34' is greater than the width of transistor 78'. Appropriate ratios may be arrived at by running simulations seeking the largest possible noise margins. Of course, combinations of ratioing and control of well potential may also be used where appropriate.

Figure 15:
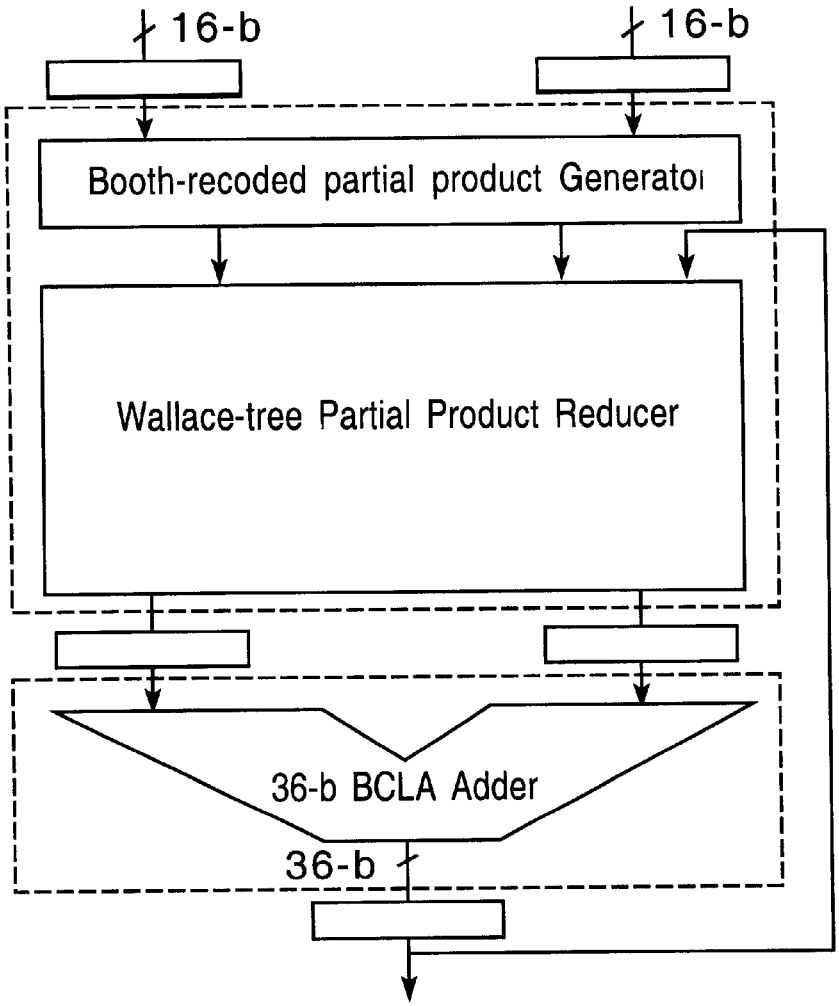
FIG. 15 is a block diagram illustrating a 16*16+36-bit MAC architecture.
Figure 16:
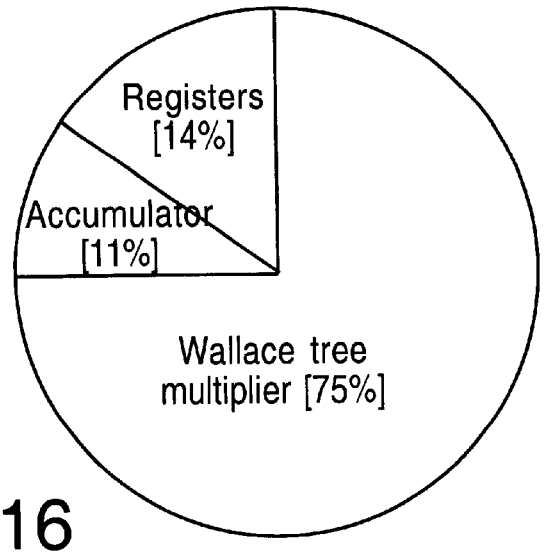
FIG. 16 is a pie chart illustrating power distribution on a 0.5 $\mu$m static CMOS implementation of the invention.

A two's complement, fixed-point 16*16+36-bit MAC was fabricated in a commercial 0.5$\mu$ CMOS process. The MAC comprises of an Overlapped bit-pair Booth-recoded, (3,2) counter-based Wallace tree 16*16-bit multiplier and a 36-bit Block Carry Lookahead final accumulator, with a single pipeline stage between the multiplier and accumulator for enhanced throughput, shown in FIG. 15. The power distribution measured on a static CMOS implementation of the MAC is shown in FIG. 16. The Wallace tree multiplier is the most power-critical MAC component, consuming 75% of total power. This is due to the substantial interconnect capacitances driven by the 28-transistor-based (3,2) counter within the Wallace tree. In order to lower the multiplier power, three versions of the MAC are fabricated with the multiplier constructed in series-regulated QuadRail, off-chip regulated QuadRail, and conventional static CMOS to study the relative power-delay trade-offs. The final accumulator, due to its higher logic depth than the multiplier, is the most time-critical MAC component and hence sets the maximum clock frequency. It is therefore implemented in full-swing static CMOS in all MAC versions to retain a fixed, high throughput. All three MACs have CMOS-level I/Os to enable interfacing with external CMOS circuitry without level conversion.

Figure 17:
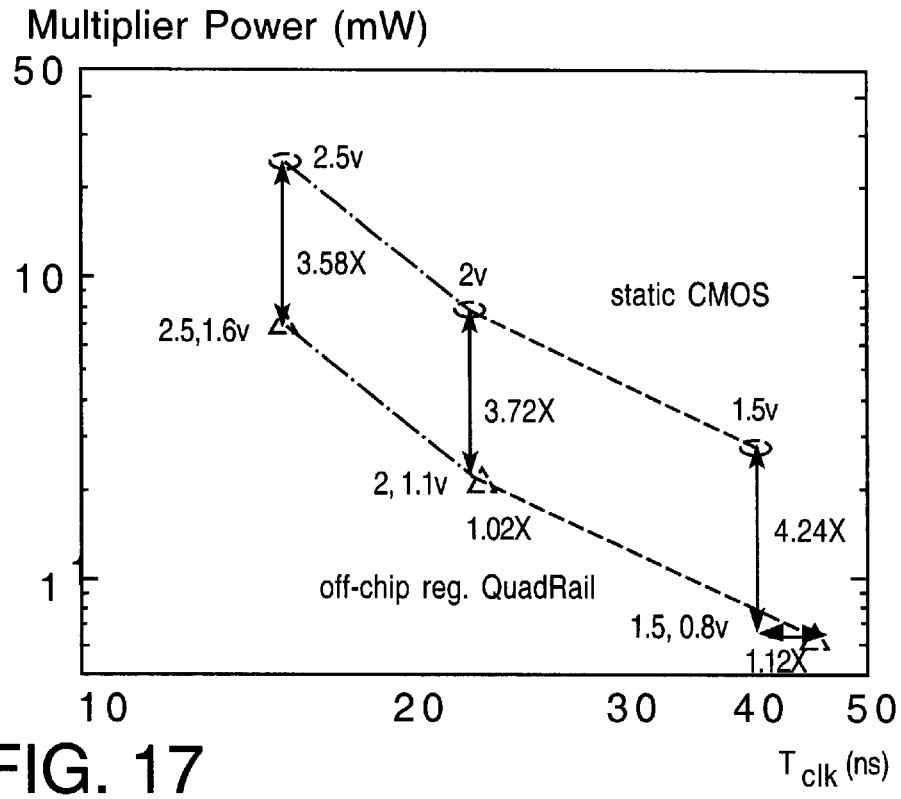
FIGS. 17 and 18 are charts illustrating static CMOS versus QuadRail power-delay comparison measurements.
Figure 18:
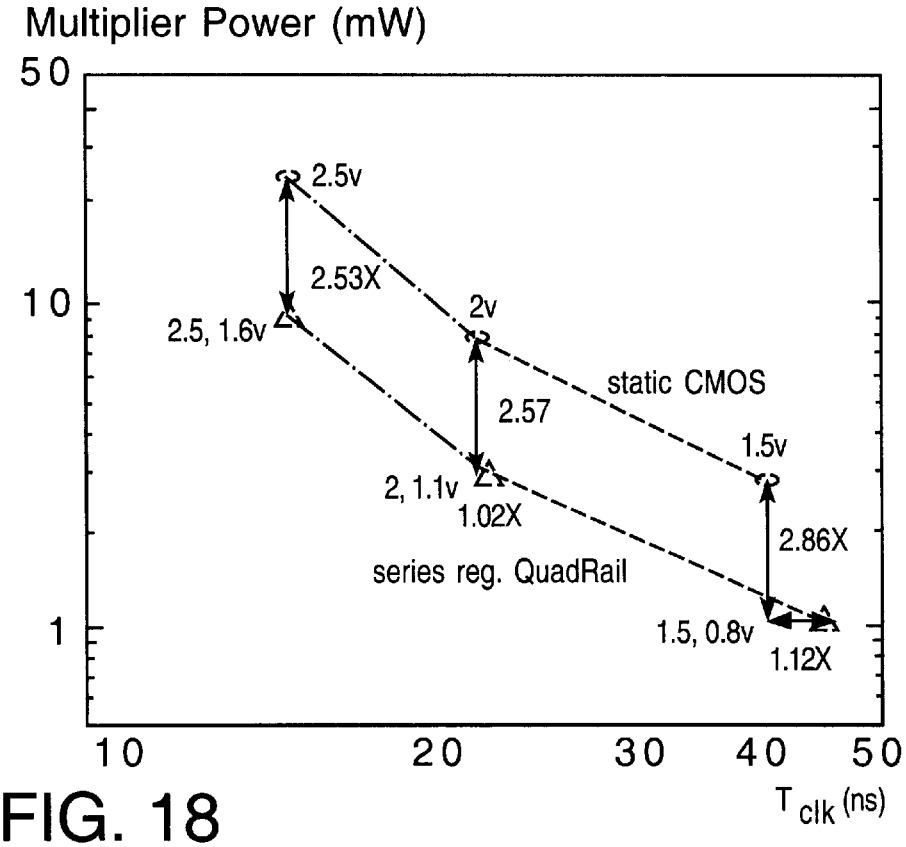
Figure 19:
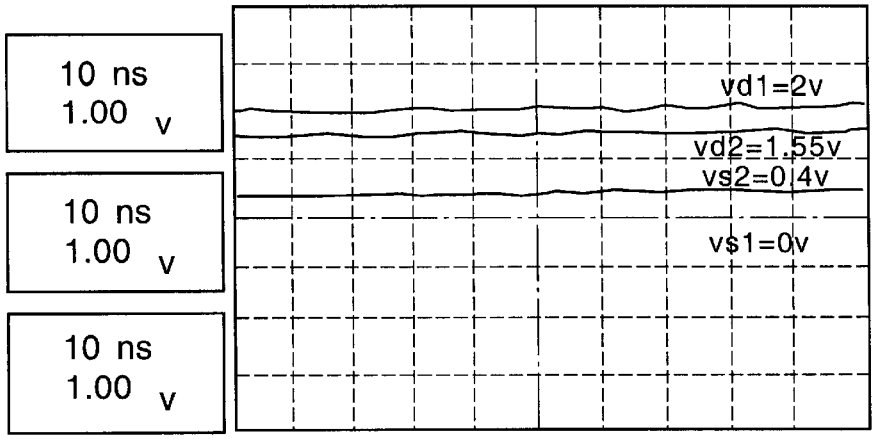
FIG. 19 is a chart illustrating 0.5 um series-regulated QuadRail MAC measured power-rail waveforms.

FIGS. 17 and 18 show the measured Wallace tree multiplier power-delay comparisons for static CMOS vs. the QuadRail methodologies over a range of operating voltages (2.5–1.5V), i.e., $V_{dd}$ for CMOS and $V_{logic}$ for QuadRail. QuadRail's corresponding buffer voltages are selected to maintain an $I_{off}/I_{on}$ ratio of 1:150, which balances static and dynamic power within the QuadRail multiplier while meeting the target delay constraints set by the CMOS MAC. FIG. 19 shows the low-swing rail waveforms from the series-regulated QuadRail MAC at Vd1=2V, Vs1=0V. Measured peak-to-peak power/ground bounce on the low-swing power rails is confined to within 8% of the low-swing voltage with 4 pF on-chip inter-rail decoupling capacitors.

Power and delay are measured across 500 pseudo-random input vectors. The off-chip regulated QuadRail approach shows energy/operation savings ranging up to 3.79× over static CMOS, with the savings increasing with voltage scaling. The savings are attributed to the following:

- Average point-to-point net capacitance (due to both interconnect and fanout gate loading) extracted from the Wallace tree multiplier layout is 48fF. This, coupled with the inherently high switching activities of Wallace trees makes the effective switched capacitance per cycle substantial. A full quadratic reduction in buffer stage dynamic power is achieved due to the lowered output swing across this capacitance.
- 28% of the dynamic power within the multiplier is due to short-circuit power dissipation, despite the multiplier being optimally sized to maintain steep input rise/fall times. Thus, the reduced buffer stage swing offers a nearly cubic reduction in its short-circuit power component as well, contributing to the additional energy/operation savings.

Series-regulated QuadRail offers relatively lower energy/operation savings than off-chip regulated QuadRail, due to the DC series path between the power supplies. Therefore, the buffer stage dynamic power reduction factor drops from quadratic to linear. However, the nearly cubic reduction in buffer stage short-circuit power is still retained, contributing to an energy/operation savings slightly larger than linear. The savings range up to 2.55×, i.e., up to a 35% loss in savings compared to off-chip regulated QuadRail. At 67 MHz/23 MHz (maximum/minimum measured clock speed), the total series-regulated QuadRail MAC power (i.e., multiplier, accumulator, and registers) is 16.6 mW/2.06 mW. Series-regulated QuadRail's DC power disadvantage is offset by the following advantages:

- Standby power (152.5 nW) is nearly three orders of magnitude lower than off-chip regulated QuadRail's standby power (143.8 $\mu$W), because of the absence of the Vd1–Vs1 totempole current path during sleep mode. Further, transition between sleep and active mode is accomplished in a single clock cycle. Since transitioning to sleep mode essentially transforms QuadRail into conventional static CMOS, circuit state is still retained during standby. Thus, transitioning between sleep and active modes eliminates the need for any explicit state data transferring schemes.

Since the additional low-voltage supply is not required, series-regulated QuadRail is a self-contained methodology that can replace static CMOS operating from a regular, high-swing supply without mandating any system-level modifications.

Figure 20:
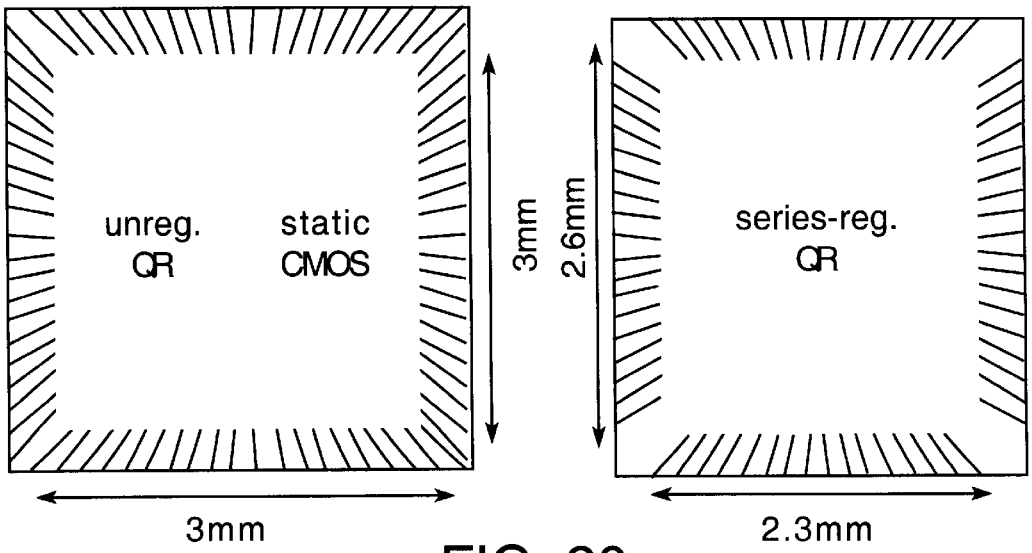
FIG. 20 is a microphotograph of static CMOS, QuadRail MAC die microphotographs.

FIG. 20 shows the static CMOS and QuadRail MAC die microphotographs. The off-chip regulated QuadRail MAC occupies about 10% larger layout area due to intrinsic cell-layout area penalty incurred by its dual-well requirement. Series-regulated QuadRail MAC incurs an additional 8% area penalty due to the on-chip decoupling capacitors.

Figure 21:
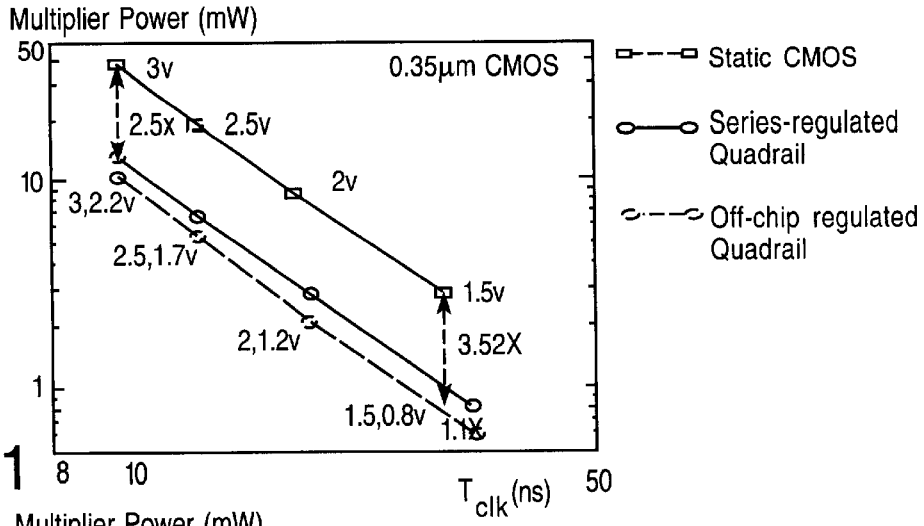
FIGS. 21–23 are charts illustrating static CMOS versus QuadRail power-delay comparisons in 0.35 um CMOS, 0.25 um FDSOI, and 0.16 um CMOS processes.
Figure 22:
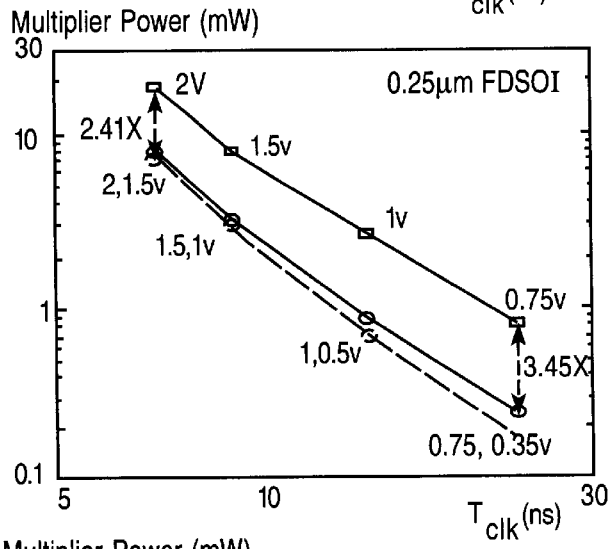
Figure 23:
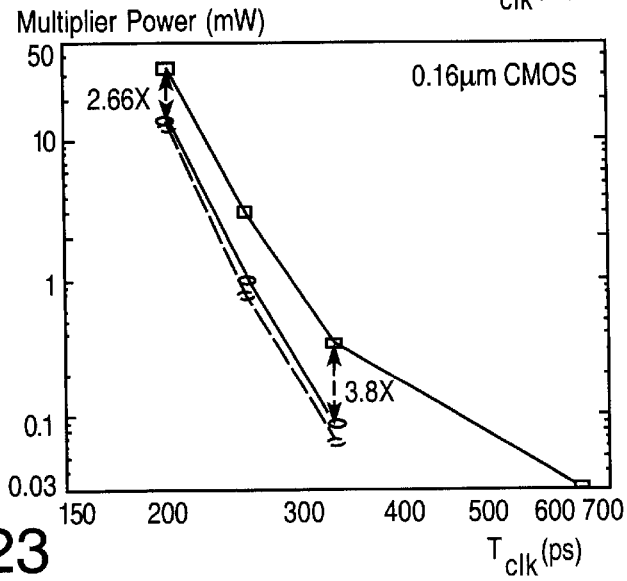

The power-delay comparisons are extended over three additional commercial single-threshold processes: 0.35 $\mu$m CMOS, 0.25 $\mu$m FDSOI, and 0.16 $\mu$m CMOS, to study the impact of process scaling on energy/operation savings (FIGS. 21–23). Series-regulated QuadRail energy/operation savings increase with process scaling: up to 3.2× in 0.35 $\mu$m, 3.45× in 0.25 $\mu$m, and 3.8× in 0.16 $\mu$m processes. The 0.25 $\mu$m implementation's lowest energy/operation (at $V_{logic}$=0.75V, $V_{buffer}$=0.35V) is 6pJ. This is nearly 3.3× lower than one of the lowest reported energy/operation implementations in literature in a comparable multi-threshold 0.25 $\mu$m process. Since interconnect capacitance scales slower than gate capacitance with process scaling, the Wallace tree multiplier, because of its interconnect-dominated point-to-point net capacitances, becomes more and more power-critical. This, coupled with the increasing ratios of logic to buffer swings with process scaling, makes driving the multiplier's load capacitances at lower swings to offer improved energy/operation savings. The savings increase even further with process scaling beyond our range of analysis.

Figure 24:
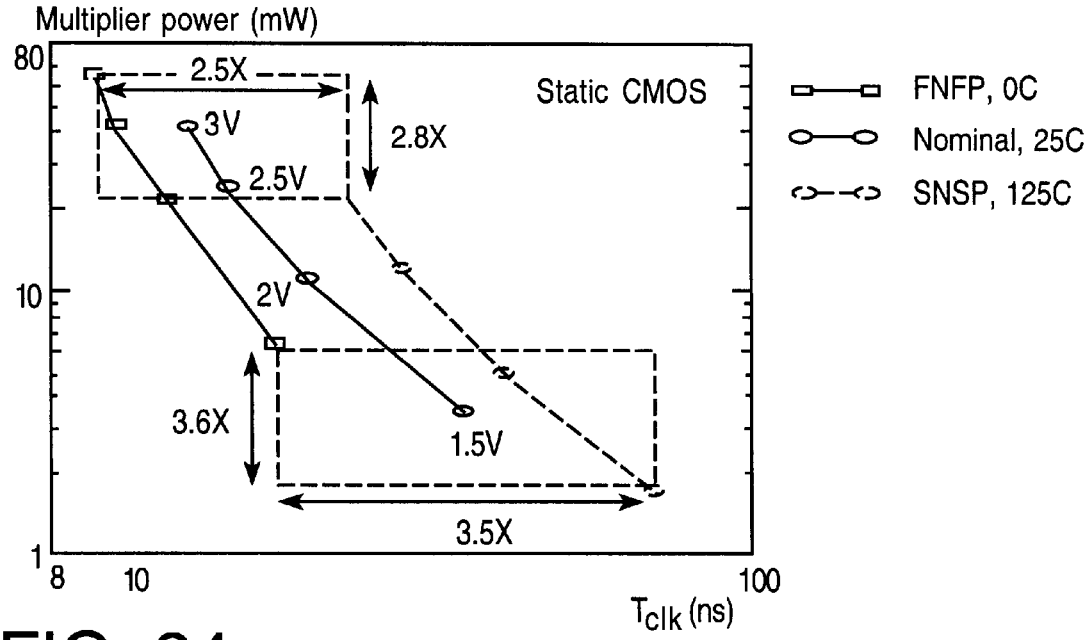
FIGS. 24 and 25 are charts illustrating static CMOS versus series-regulated QuadRail power*delay dispersion analysis in 0.5 um processes.
Figure 25:
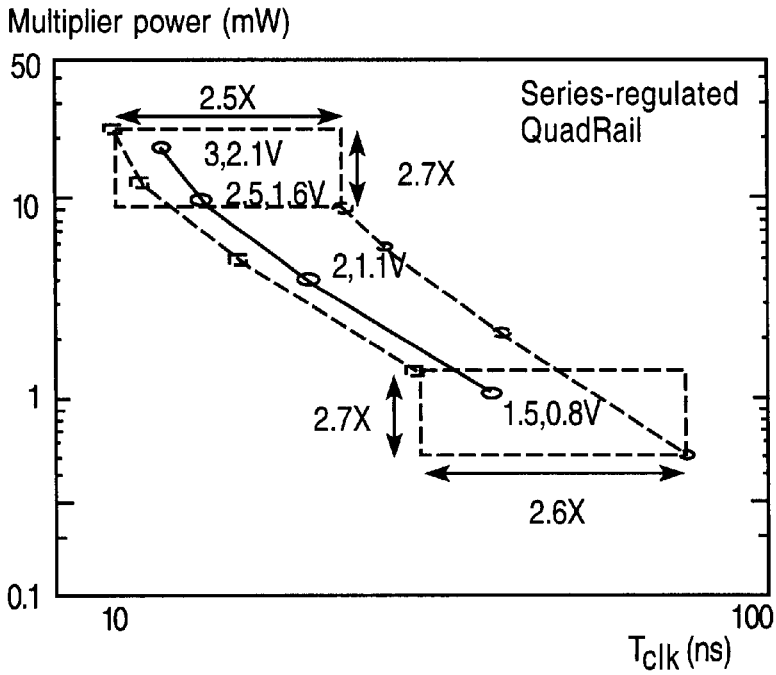

To study the impact of series-regulated QuadRail on manufacturability, worst-case process and temperature corner analysis is performed across industrial Slow-NMOS-Slow-PMOS and Fast-NMOS-Fast-PMOS corners of the CMOS and QuadRail multipliers in the 0.5 $\mu$m process, shown in FIGS. 24 and 25. QuadRail demonstrates similar power*delay dispersions as CMOS at high voltages. With voltage scaling, the dispersion remains well controlled and at $V_{logic}$=1.5V, $V_{buffer}$=0.5V, the power*delay dispersion is 1.8× lower than CMOS, demonstrating improved low-voltage parametric yield. This is attributed to (i) the low-swing rails being dynamically offset across corners to maintain the target $I_{off}/I_{on}$ ratio, thereby significantly compensating for the manufacturing variations, and (ii) the reduced output swings of QuadRail gates causing the power and delay sensitivities to worst-case corners to be relatively lower than in static CMOS. Further electronic variations control for both QuadRail and CMOS may be achieved through substrate/well back-biasing schemes.

In summary, up to 2.55× energy/operation savings were measured over static CMOS, while offering a simultaneous 1.8× low-voltage manufacturability improvement, without requiring any process or system-level modifications. Experimental results from three additional processes were also presented to show increased savings over static CMOS with process scaling.

The present invention may be utilized in many different devices, such as application specific integrated circuits, single-chip or multi-chip microprocessors, and special purpose microprocessors, such as a digital signal processor or a graphics processor.

The present invention also includes a method of operating a multiple power supply architecture, including controlling a power system for a circuit. The method includes providing a first power supply, providing a second power supply, connecting the first power supply to the second power supply for sleep mode, and disconnecting the first power supply from the second power supply for non-sleep mode. Connecting the power supplies may be accomplished by shorting the first and second power supplies together, such as with switches or power supplies, as discussed hereinabove. Similarly disconnecting the power supplies may be accomplished by opening a switch or transistor, or by using a power supply to produce a voltage between the first and second power supplies. The method may be used locally in a circuit or globally, as discussed hereinabove. For example, the method may be used in a circuit as described with regard to FIG. 6, such as by producing a signal indicative of a signal propagating through a critical path of at least one of the first and second circuits, and by controlling one of the first and second power supplies in response to the signal. That method may use a dummy critical path, or may utilize the actual critical path, as discussed hereinabove.

Those of ordinary skill in the art will recognize that many modifications and variations of the present invention may be implemented. For example, although the invention has been described largely in terms of using at least two selective connectors 16, 18, the present invention may be utilized with only one selective connector or, in some embodiments, without any selective connectors. The foregoing description and the following claims are intended to cover all such modifications and variations.

What is claimed is:

1. A power system, comprising:

a first voltage rail;

a first reference rail, wherein said first voltage rail and said first reference rail form a first power supply for powering a first circuit;

a second voltage rail;

a second reference rail, wherein said second voltage rail and said second reference rail form a second supply for powering a second circuit; and a first selective connector between said first and second voltage rails.

2. The system of claim 1, further comprising a second selective connector between said first and second reference rails.

3. A power system, comprising:

a first voltage rail;

a first reference rail;

a second voltage rail;

a second reference rail;

a first selective connector between said first and second voltage rails;

a second selective connector between said first and second reference rails;

at least one additional voltage rail;

at least one additional reference rail;

at least one additional selective connector between said at least one additional voltage rail and at least one of said first and second voltage rails; and another at least one additional selective connector between said at least one additional reference rail and at least one of said first and second reference rails.

4. The system of claim 1, wherein:

said first voltage and reference rails form a first power supply;

said second voltage and reference rails form a second power supply; and said first and second power supplies have voltage swings that are overlapping.

5. The system of claim 4, wherein said first and second power supplies are centered.

6. The system of claim 1, wherein:

said first voltage and reference rails form a first power supply;

said second voltage and reference rails form a second power supply; and said first and second power supplies have voltage swings that are not overlapping.

7. The system of claim 1, wherein:

said first voltage and reference rails form a first power supply having a first voltage swing; and said second voltage and reference rails form a second power supply having a second voltage swing, wherein said first voltage swing is greater than said second voltage swing.

8. The system of claim 2, wherein said first and second selective connectors are selected from a group consisting of mechanical switches, transistors, and power supplies.

9. A circuit comprising:

a first circuit;

a first voltage rail connected to said first circuit;

a first reference rail connected to said first circuit;

a second circuit;

a second voltage rail connected to said second circuit;

a second reference rail connected to said second circuit; and a first selective connector between said first and second voltage rails.

10. The circuit of claim 9, further comprising a second selective connector between said first and second reference rails.

11. A circuit, comprising:

a first circuit;

a first voltage rail connected to said first circuit;

a first reference rail connected to said first circuit;

a second circuit a second voltage rail connected to said second circuit;

a second reference rail connected to said second circuit;

a first selective connector between said first and second voltage rails;

at least one additional circuit;

at least one additional voltage rail connected to said at least one additional circuit;

at least one additional reference rail connected to said at least one additional circuit;

at least one additional selective connector between said at least one additional voltage rail and at least one of said first and second voltage rails; and another at least one additional selective connector between said at least one additional reference rail and at least one of said first and second reference rails.

12. The circuit of claim 9, wherein said first and second circuits form a CMOS circuit architecture.

13. The circuit of claim 9, wherein:

said first voltage and reference rails form a first power supply;

said second voltage and reference rails form a second power supply; and said first and second power supplies have voltage swings that are overlapping.

14. The circuit of claim 13, wherein said first and second power supplies are centered.

15. The circuit of claim 9, wherein:

said first voltage and reference rails form a first power supply;

said second voltage and reference rails form a second power supply; and said first and second power supplies have voltage swings that are not overlapping.

16. The circuit of claim 9, wherein:

said first voltage and reference rails form a first power supply having a first voltage swing; and said second voltage and reference rails form a second power supply having a second voltage swing, wherein said first voltage swing is greater than said second voltage swing.

17. The circuit of claim 10, wherein said first and second selective connectors are selected from a group consisting of mechanical switches, transistors, and power supplies.

18. The circuit of claim 10, further comprising a controller connected to said second voltage rail, connected to said second reference rail, and responsive to a signal indicative of signal propagation through at least one of said first and second circuits.

19. The circuit of claim 18, wherein said controller is directly connected to said second voltage rail and said second reference rail.

20. The circuit of claim 18, wherein said controller is connected to said second voltage rail and said second reference rail via said first and second selective connectors.

21. The circuit of claim 18, further comprising a dummy critical path connected to said controller.

22. The circuit of claim 10, further comprising a controller responsive to a signal indicative of signal propagation through at least one of said first and second circuits, and having a first output terminal connected to said first selective controller and a second output terminal connected to said second selective controller.

23. The circuit of claim 22, further comprising a dummy critical path connected to said controller.

* * * * *